US005099724A

United States Patent [19]

Reddy, Jr.

[11] Patent Number: 5,099,724

[45] Date of Patent: Mar. 31, 1992

[54] STRIKING DEVICE

[76] Inventor: William L. Reddy, Jr., 22 Matthew Dr., Salem, N.H. 03079

[21] Appl. No.: 359,982

[22] Filed: Jun. 1, 1989

Related U.S. Application Data

[63] Continuation-in-part of Ser. No. 180,083, Apr. 11, 1988, abandoned.

[51] Int. Cl.[5] ..... B25D 1/00

[52] U.S. Cl. ..... 81/20; 81/177.2

[58] Field of Search ..... 81/20, 25, 177.2, 489; 403/108, 166, 349; 16/115

[56] References Cited

U.S. PATENT DOCUMENTS

| | | | |
|---|---|---|---|
| 587,464 | 8/1847 | Swick et al. | 81/177.2 |
| 1,753,441 | 4/1930 | Morehouse | 81/177.2 |
| 3,185,146 | 5/1965 | Leopoldi | 81/25 |
| 4,409,866 | 10/1983 | McBride | 81/177.2 |
| 4,558,726 | 12/1985 | Clay | 81/20 |

*Primary Examiner*—D. S. Meislin

*Attorney, Agent, or Firm*—Edward A. Gordon

[57] ABSTRACT

A striking device for impacting an object including a head member and an actuating arm member attached to the head member. The arm member is provided with an elongated sleeve member having a channel therein adapted for slidable engagement over at least a portion of the arm member and adjusting means adapted in association with the sleeve member to releasably engage the arm member and secure the sleeve member at selected positions along the arm member to provide adjustment of the overall effective length of the arm member.

2 Claims, 3 Drawing Sheets

STRIKING DEVICE

This application is a continuation-in-part of application Ser. No. 180,083 filed on Apr. 11, 1988, now abandoned.

FIELD OF THE INVENTION

This invention relates to striking devices and more particularly to improvements in the construction and operation of hammers or the like tools to provide variable effective actuation and use of the tool.

BACKGROUND OF THE INVENTION

Striking devices such as hammers have been in use for many years. Such hammer devices or tools include, for example, the standard claw hammers employed for standard household and construction work; the ball-peen hammers employed by tool and die makers, tinsmiths and other metal workers, and the Warrington hammer employed in fine woodworking such as cabinet making. Generally, such prior art devices had stationary heads designed or configured to accomplish the particular work to be performed and handles which were fixedly and non-adjustable attached to the head. Examples of more recent prior art are disclosed in the following U.S. Patents.

U.S. Pat. No. 266,045 discloses a combination hammer, hatchet and nail puller wherein the outer portion of the handle is vertically slidable upon the inner lever portion of the handle so as to serve as a percussion weight to be driven downwardly to drive the nail remover claws into the wood about the nail to be removed.

U.S. Pat. No. 3,385,334 discloses a soft head hammer wherein the hammerhead is threadably engaged to the hammer handle.

U.S. Pat. No. 3,901,297 discloses a hammerhead mounting which permits replacing of the head and also provides for a key means to prevent rotation of the head.

While the prior art devices have provided improvements in the areas intended, there still exists a great need for a striking device such as a hammer which permits the user to quickly and easily adjust the effective length of the actuating lever to vary the impact and leverage consistent with the desired use.

Accordingly a principal desirable object of the present invention is to provide an improved striking device having an actuating lever which can be readily and easily adjusted to vary the effective length and use of the striking device.

Another desirable object of the present invention is to provide an improved lever handle for hammers and the like tools which can be quickly and effectively lengthened or shortened to vary the impact and leverage of the hammer.

A still further desirable object of the present invention is to provide, in a striking device of the foregoing objects, a locking mechanism for quickly releasably securing the handle member so that the handle length may be quickly and effectively varied, and which is constructed and arranged so that it does not interfere with the grip of the user's hand(s).

These and other desirable objects of the invention will in part appear hereinafter and will in part become apparent after consideration of the specification with reference to the accompanying drawings.

SUMMARY OF THE INVENTION

The present invention provides a striking device for impacting an object comprising a head and an actuating handle. The handle is constructed and arranged so as to have an inner elongated arm member attached to the head and an outer elongated sleeve member which is relatively lengthwise slidable on the inner arm member to thereby vary the length of the actuating handle. Interlocking means are provided for releasably securing the outer sleeve member at selected positions along the inner arm member to vary the overall effective lever length of the handle. The interlocking means includes adjusting means which are constructed and arranged so as not to interfere with the grip of the user's hand(s).

BRIEF DESCRIPTION OF THE DRAWINGS

For a fuller understanding of the nature and desired objects of the invention, reference should be had to the following detailed description taken in connection with the accompanying drawings wherein like reference characters denote corresponding throughout the several views and wherein.

DETAILED DESCRIPTION OF PREFERRED EMBODIMENT(S)

Figure 1:
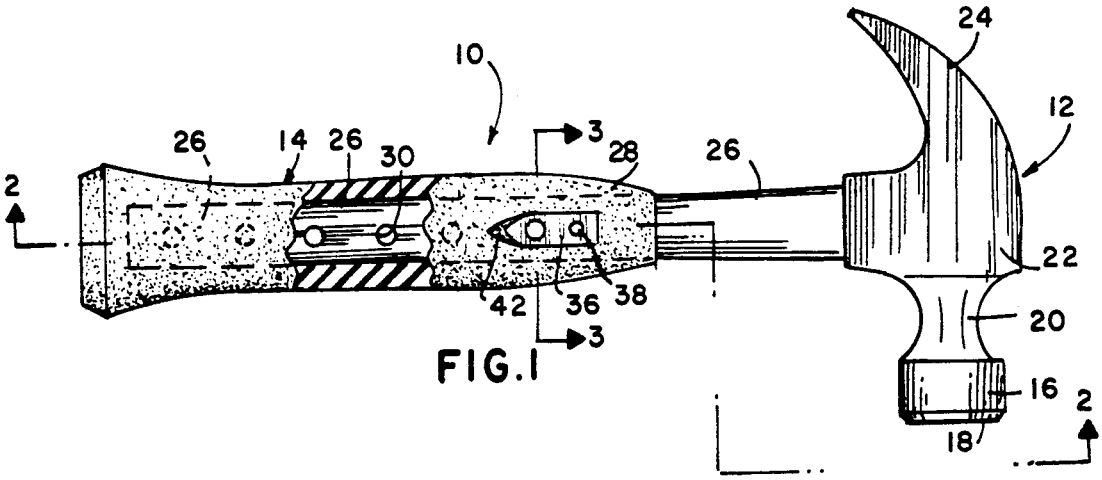
FIG. 1 is a side elevational view partly broken away of a striking device embodying the present invention.
Figure 2:
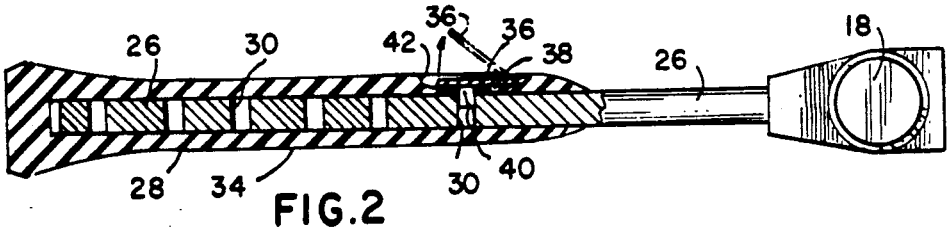
FIG. 2 is a cross-sectional view taken substantially along the line 2—2 of FIG. 1 in the direction indicated by the arrows thereon.
Figure 3:
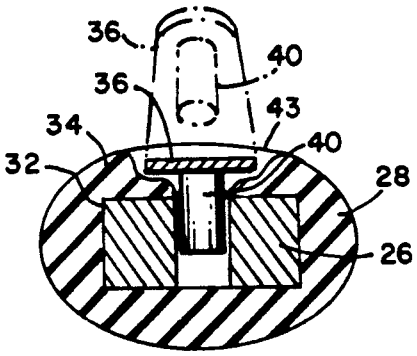
FIG. 3 is a cross-sectional view taken substantially along the line 3—3 of FIG. 1 in the direction indicated by the arrows thereon.

Referring now to the drawing and more particularly to FIGS. 1–3, the improved striking device shown generally at 10 comprises a head 12 and an actuating handle 14. The head 12 is illustrated in the form of a typical carpenter's claw hammerhead and includes a bell portion 16 having a striking face 18, a neck portion 20, a cheek portion 22, and a claw portion 24 for removing nails and the like. The actuating handle 14 comprises an inner elongated arm member 26 and an outer elongated sleeve member 28. The inner arm member 26 is attached at one end to the head member 12. While it is preferred to fabricate the head and inner arm member out of metal such as steel as a unitary integral structure, the head and inner arm members can be fabricated separately and then attached by such known methods as welding. The inner arm member 26 is provided with a plurality of slots or holes 30 as described hereinafter.

Figure 4:
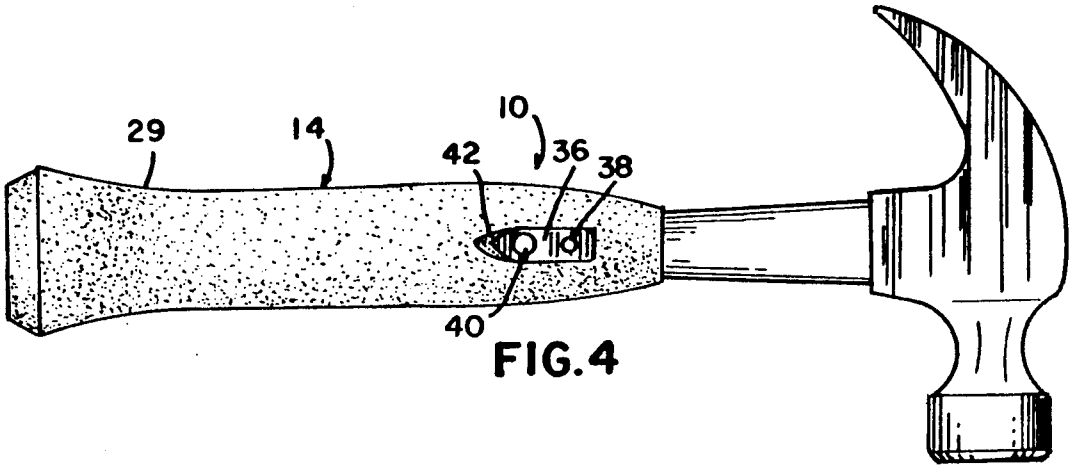
FIG. 4 is a side elevational view of a hammer embodying the novel features of the present invention and shown in its shortened operative position.
Figure 5:
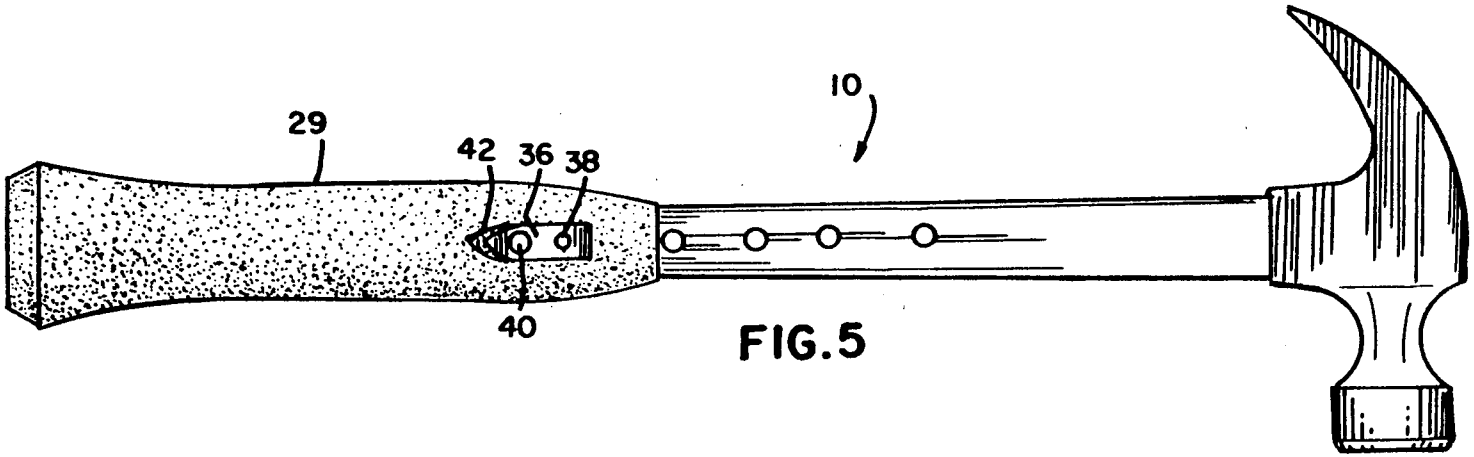
FIG. 5 is a side elevational view of the hammer of FIG. 4 but shown in its lengthened operative position.

The outer sleeve member 28 is preferably formed of a hard plastic or rubber material, although it may be formed of other materials such as wood, metal, or combinations of all such materials. The inner dimensions of the sleeve or sleeve channel 32 are constructed so that the sleeve 28 can slidably receive the inner arm member 26. While the shape of the inner arm member 26 enclosed by the sleeve member and the mating sleeve channel 32 can be varied, configurations which resist torque forces such as rectangular, square and elliptical shapes are preferred. The outer surface 34 of the sleeve member 28 can be configured to provide a groove portion 29, as best seen in FIGS. 4 and 5, to facilitate the users hand grip as is known.

The sleeve member is provided with a length adjusting means whereby the sleeve member can be readily adjusted by sliding it forward or backward to vary the effective overall length of the handle 14. As shown, the adjusting means comprises a resilient latching member 36 which is secured at one end to the outer surface of the sleeve member 28 by attaching means such as screw 38. A mating latching pin or stud 40 is disposed on and carried by the inner side of the other end of the resilient member 36 and is configured so as to mate with and be received by the holes 30. The holes 30, as illustrated in FIGS. 1-3, are disposed in the arm member 26 in spaced parallel vertical relationship to each other. Also, as shown in the embodiment of the striking device illustrated in FIGS. 1-3, the axial plane of the holes 30 is perpendicular to the plane of the head member 12. The resilient member 36 and stud 40 can be formed of a suitable metal material. In a preferred embodiment (as best seen in FIGS. 2, 3, 7 and 8), the adjusting means is disposed in a groove or recess 42 formed in the sleeve member 28 so that it is flush with or below the rim edge 43 of groove 42 or the outer surface 34 of the sleeve member 28 and therefore will not interfere with the use or grip of the user's hand.

In normal use of the striking device of the present invention the length of the handle 14 can readily lengthen or shorten to vary the overall effective length of the handle by the user raising the latching member sufficiently upwardly so that the pin member 40 is clear of the hole 30 into which it was inserted in the inner arm member 26 as shown by the dotted lines of FIG. 2. The outer sleeve member 38 is then slid forward or backward until the desired overall length of the handle 14 is obtained at which position the latching member 36 is released so that the pin 40 engages the adjacent hole 30 and locks the sleeve 28 into the selected position to provide the desired effective length for the work to be accomplished.

From the foregoing it can be appreciated that the striking device of the present invention permits the user to accomplish tasks which would require separate striking devices. For example, reference now also being made to FIGS. 4 and 5, the striking device 10 of FIG. 4 is in the form of a claw hammer with the handle in its shortened form. In the shortened form the device 10 can be employed in the task of nailing interior finish work or exterior work such as clapboards which do not require maximum striking force to drive the small nail used for such tasks. Alternatively when the striking device 10 is in its lengthened form as shown in FIG. 5 it can readily be employed in the task of framing which requires greater actuating leverage and impact force to drive in the larger and longer nails associated with framing construction. Additionally the lengthened form of FIG. 5 and its greater leverage facilitates the pulling of mails which would be difficult for the shortened form of FIG. 4. It is apparent that the present invention provides an improved striking device which can be employed in multiple tasks which formerly required separate specific devices.

Figure 6:
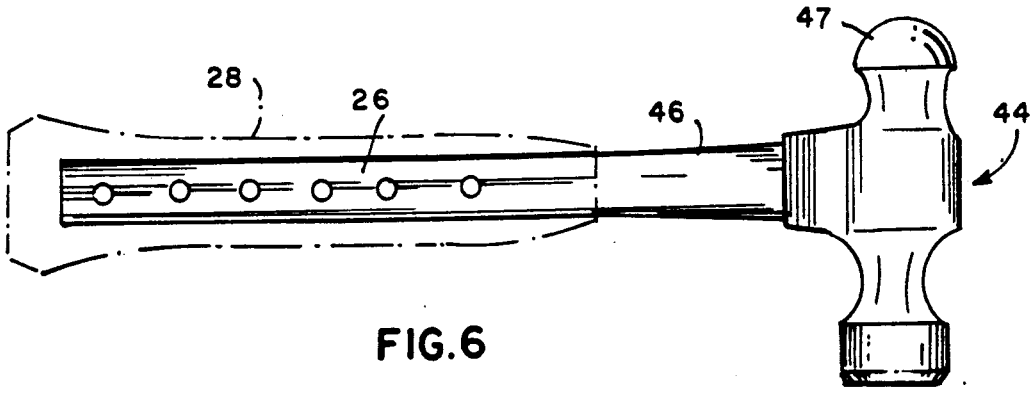
FIG. 6 is a side elevational view of an interchangeable hammerhead and inner arm member in accordance with the present invention.

The present invention also contemplates an outer sleeve member with interchangeable inner arm members having striking heads for different types of work. For example, as illustrated in FIG. 6, the inner arm 26 is provided with a ball-peen hammerhead 44 which has a bell-shaped ball (the peen) 47 instead of a claw 24 as shown in FIG. 1.

In accordance with the present invention when the user's task requires a ball-peen hammer, the claw hammer 18 and associated arm 26 of FIG. 1 are removed from the sleeve 28 and the ball-peen hammer 44 and associated arm 26 are inserted in place thereof.

Figure 7:
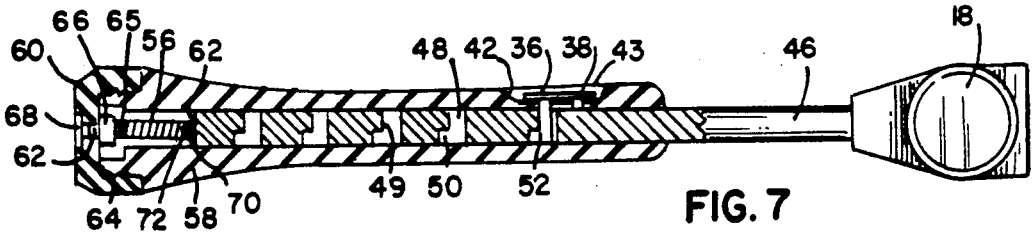
FIG. 7 is a fragmentary cross-sectional view of an alternate embodiment of the striking device of the present invention.
Figure 7A:
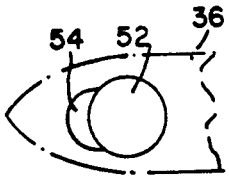
FIG. 7A is a top elevational view of the interlocking stud member of FIG. 7.

Referring now to FIGS. 7 and 7A, there is illustrated an alternate embodiment of the present invention. As shown the inner arm member 46 is provided with slots or apertures 48 in which walls 49 have been undercut to provide an additional recess or space 50 which extend rearwardly beyond the main inner wall 49 of the aperture 48. The interlocking pin 52 of sleeve 58 is provided with a mating lip portion 54 which is urged into the recess 50 by spring means 56 acting upon arm 46 after the pin 52 is inserted into the selected aperture 48. The diameter of the apertures 48 is sufficient to receive the stud 52 and associated lip 54. The end of the sleeve member 58 is provided with a cap 60 which threadedly engages the sleeve member 58.

The spring member 56 is interposed between the rear surface 62 of the inner arm 46 and the inner surface 64 of cap 60. In the embodiment illustrated the end 65 of the spring is attached to plate 66 by suitable means such as welding and plate 66 releasably attached to the inner surface 64 of cap 60 by means such as bolt 68. The spring 56 is preferably a helical or coil spring which when compressed imparts an expansion motion to arm 46 thereby urging the lip 54 of pin 52 into the recess 50 to insure the interlocking of arm 46 with sleeve 58 in the selected aperture and position relative to each other. It is to be understood that the invention also contemplates an embodiment wherein the spring 56 is not attached to the cap 60 but freely interposed between the cap 60 and the arm 46. Also in an alternate embodiment the end 70 of spring 56 can be releasably attached to the hook 72 disposed on the rear surface 62 of arm 46. When the spring 56 is attached to both the cap 60 and arm 46, the spring 56 serves to prevent the arm 46 and sleeve 56 from separating in the event the interlocking pin 52 is moved beyond the last aperture 48 of the arm 46 and thereby provides a safety feature. As described with respect to FIGS. 1-5, the adjusting means including the resilient latching member 36, attaching means 38 and pin 52 are disposed in groove or recess 42 formed in the sleeve member 28 so that the adjusting means is flush with or below the rim edge 43 of groove 42 or outer surface of the sleeve 58 so that it will not interfere with the grip of the user's hand.

Figure 8:
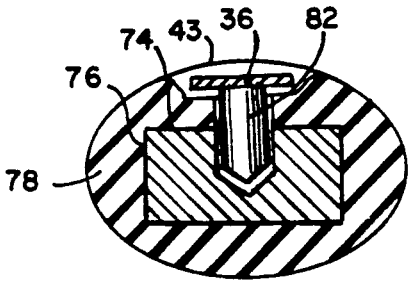
FIG. 8 is a cross-sectional view of an alternate embodiment of the striking device of FIG. 1.

Referring now to FIG. 8, there is illustrated an alternate embodiment of the striking device of FIG. 1. As shown the arm 74 is formed with a rectangular configuration which mates with the channel 76 of sleeve 78. The arm 74 is provided with a plurality of tapered bores 80 which extend into but not through the arm 74. A mating stud 82 is attached to the latching member 36, and when inserted into a selected bore interlocks the sleeve 78 and arm 74.

While the invention has been described with respect to preferred embodiments, it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in limiting sense.

What is claimed is:

1. A striking device for impacting an object comprising:

a head member;

an actuating lever arm member having one end attached to said head member;

a plurality of slots disposed in spaced relationship along said arm member;

an elongated sleeve member having a channel therein adapted for slidable engagement over the other end of said lever arm member;

a pin means carried by said sleeve member for coacting with a selected slot to releasably secure said sleeve member in a selected position on said arm member to thereby vary the effective length of said arm member;

a latching means disposed on the exterior surface of said sleeve member for actuating said pin member into a selected slot in said arm member and allow actuation of said pin member out of a selected slot;

said pin means having a lower lip portion;

the walls of each of said spaced slots being undercut to provide a recessed space to receive said lip portion; and spring means disposed in said sleeve channel for biasing said arm member outwardly thereby said lip portion is urged into said recessed space.

2. A striking device for impacting an object comprising:

a hammerhead member and an actuating handle member;

said handle member comprising:

an actuating lever arm member having one end attached to aid hammerhead member;

a plurality of slots disposed in spaced parallel relationship along said arm member;

said slots lying in the same plane;

an elongated sleeve member having a channel therein adapted for slidable engagement over the other end of said lever arm member;

said sleeve member and arm member each being configured whereby they are non-revolvable relative to each other;

a groove formed in the outer surface of said sleeve member and generally in the same plane as said parallel slots;

an opening in said sleeve member in communication with said groove, said opening lying in the same plane as said slots and communicating with said arm member and a selected slot therein;

a resilient latching member having upper and lower surfaces disposed within said groove so that the upper surface of said resilient latching member does not extend above the outer surface of said sleeve member and having one end attached within said groove to said sleeve member;

a pin member attached to the lower surface of the other end of said latching member whereby said pin member is biased inwardly by the resilient latching member so as to penetrate said sleeve opening and matingly engage a selected slot disposed in said lever arm member to thereby releasably lock said sleeve member in a selected position along said arm member to provide adjustment to the selected overall length of said handle;

said pin member being provided with a lower lip portion, and the walls of said slots being undercut to provide a recessed space to receive said lip portion and a spring means associated with said sleeve member and said arm member for urging said lip portion into the recessed space of a selected slot in said arm member.

* * * * *